United States Patent [19]

Agyagos

[11] 4,319,749

[45] * Mar. 16, 1982

[54] MULTIPLE EXERCISING DEVICE

[76] Inventor: Ferenc I. Agyagos, Sangin Bldg., 3-21-5 Akasaka, Minato-ku, Tokyo, Japan

[ * ] Notice: The portion of the term of this patent subsequent to Sep. 2, 1997, has been disclaimed.

[21] Appl. No.: 114,368

[22] Filed: Jan. 22, 1980

[30] Foreign Application Priority Data

Jan. 30, 1979 [JP] Japan ..... 54-10314[U]

[51] Int. Cl.[3] ..... A63B 21/00

[52] U.S. Cl. ..... 272/146; 272/63

[58] Field of Search ..... 272/62, 63, 93, 96, 272/97, 109, 111, 146, 144, 113, 70

[56] References Cited

U.S. PATENT DOCUMENTS

| | | | |
|---|---|---|---|
| 1,509,750 | 9/1924 | Campbell | 272/70 X |
| 3,525,522 | 8/1970 | Piller | 272/146 X |
| 3,659,844 | 5/1972 | Cummins | 272/63 X |
| 3,819,176 | 6/1974 | Cummins | 272/63 |
| 3,911,907 | 10/1975 | Smith | 272/146 X |
| 4,183,521 | 1/1980 | Kroeker | 272/146 |
| 4,220,329 | 9/1980 | Agyagos | 272/146 |

FOREIGN PATENT DOCUMENTS

| | | | |
|---|---|---|---|
| 2549286 | 5/1977 | Fed. Rep. of Germany | 272/97 |
| 52-17926 | 10/1977 | Japan | 272/146 |
| 478575 | 11/1969 | Switzerland | 272/144 |
| 984944 | 3/1965 | United Kingdom | 272/146 |
| 1211853 | 11/1970 | United Kingdom | 272/144 |

OTHER PUBLICATIONS

The Washington Post; Feb. 2, 1972; p. C22.

*Primary Examiner*—Richard J. Apley

*Attorney, Agent, or Firm*—Stevens, Davis, Miller & Mosher

[57] ABSTRACT

An exercising device is disclosed consisting essentially of a rectangular box-shaped base stand assembly having spaced preset holes into which freely rotatable easily detachable circular disks may be inserted either in single or in dual combination. When used in single mode a disk is inserted in the center hole on the base stand assembly; and when used as a dual combination the disks are inserted in the respective holes located on the right and left of the middle hole. Two inverted U-shaped pipe members parallel to each other at their respective rear ends of the base stand assembly are provided to form a pair of hand grips and supporting bars, and also relatively short supporting legs are provided for the base stand assembly, thereby affording a stable and sturdy and yet compact support for the entire device.

3 Claims, 12 Drawing Figures

FIG. 1
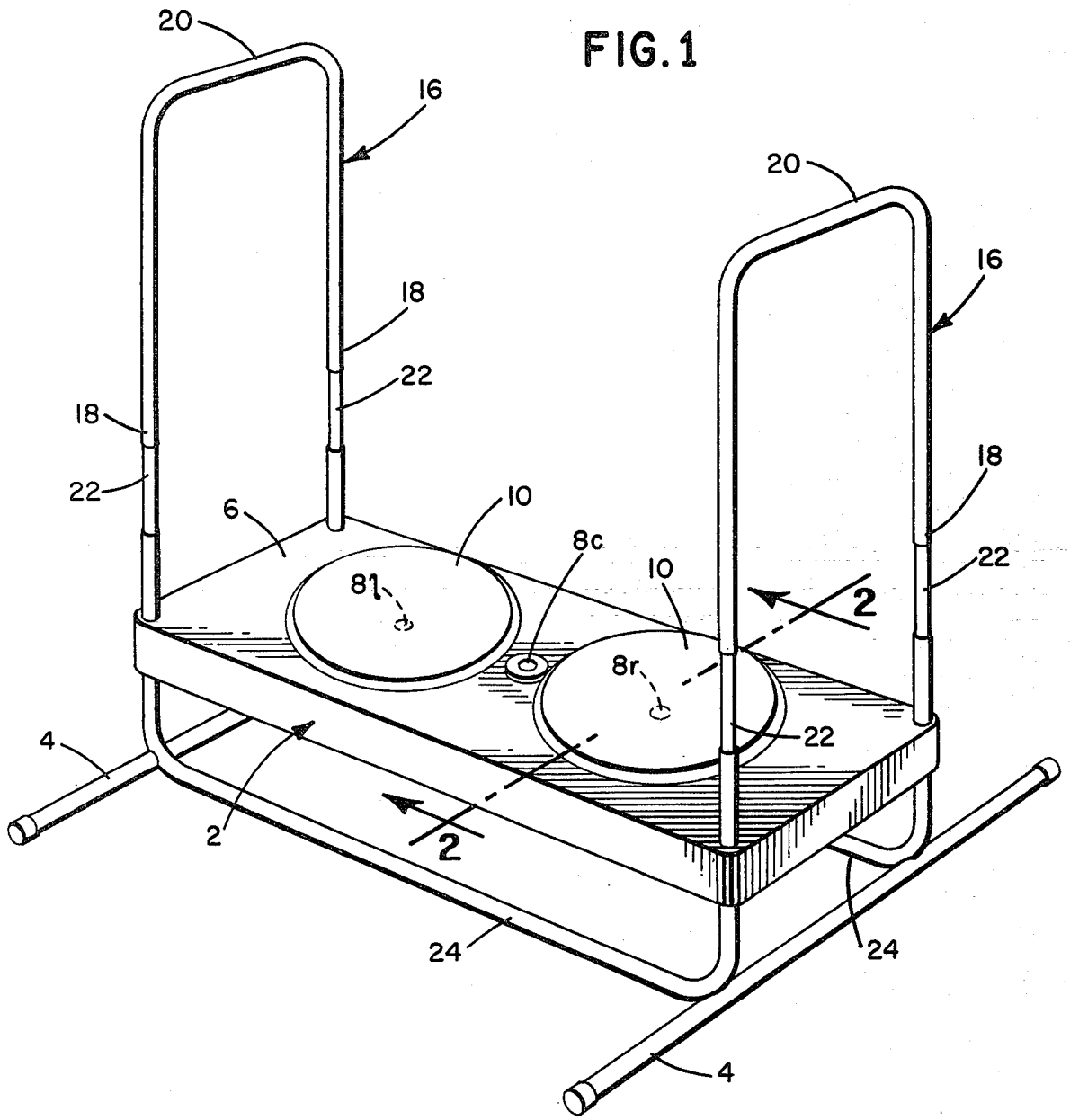
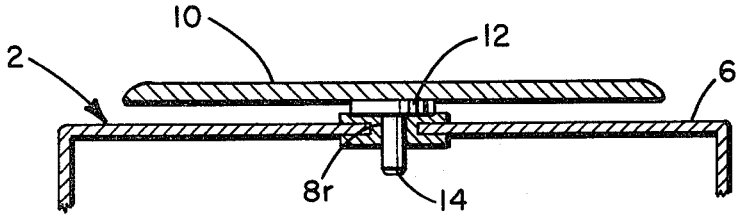
FIG. 2

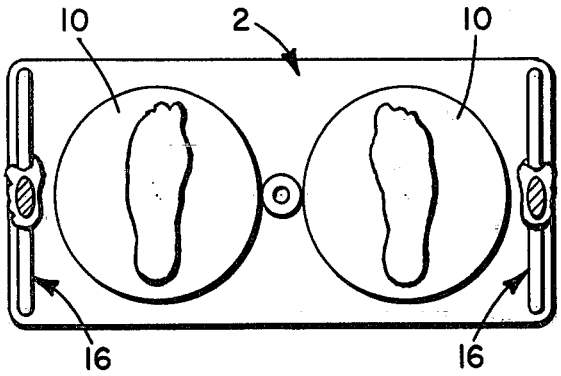
FIG. 3A
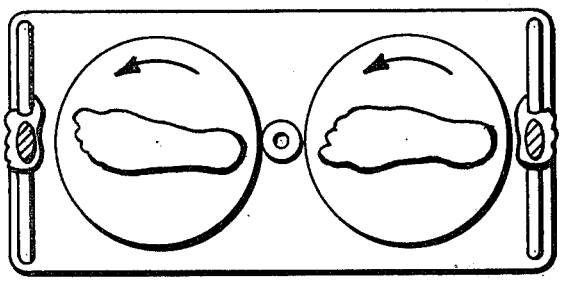
FIG. 3B
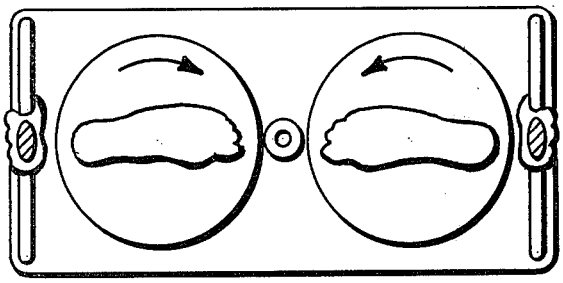
FIG. 3C
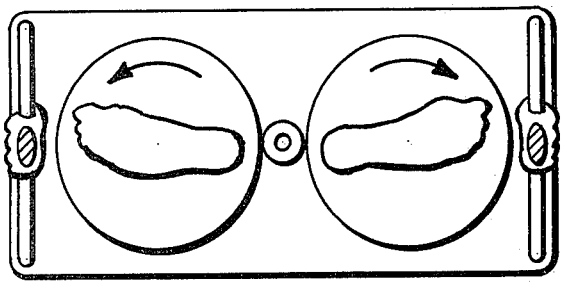
FIG. 3D
FIG. 7A
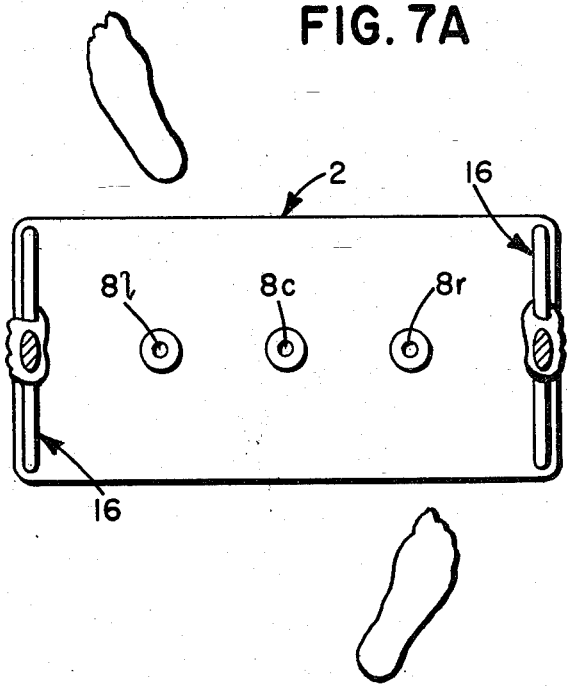
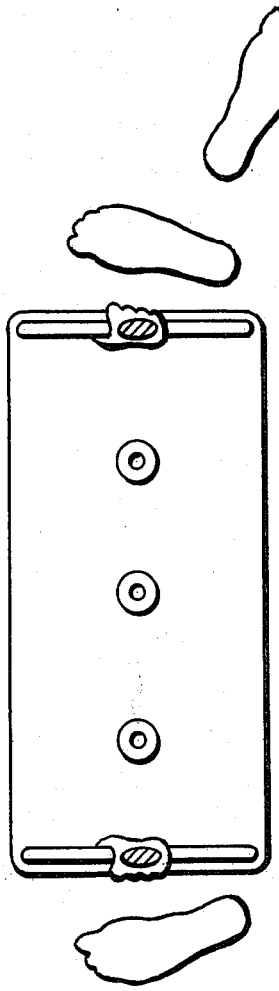
FIG. 7B

MULTIPLE EXERCISING DEVICE

This invention relates to an exercising device which is particularly well adapted to support the human body in a standing position, thus enabling the performance of wholesome exercises and simulated calisthenics ranging up to over a hundred different optional variations on what might be called a space-saving compact unit gymnasium of the present invention.

Running, stepping up and down, and jumping exercises are among those readily performable on this device which includes a top surface of a box-shaped rectangular base stand which is sufficiently elevated from the floor space upon which the device rests.

Twisting and turning exercises are performed on this device by standing on a pair of turning disks that are placed on the surface of the supporting base stand assembly. These circular disks are inserted in spaced holes on the base stand by means of a protruding hub located below and at the center of these turntables. Moreover, these disks can be utilized either singly or in dual combinations so as to provide different twisting and turning results.

The free-hand exercises and general calisthenics are performable on the base stand assembly from both sides of which extend upwardly two U-shaped pipe members that become the supporting bars for the performance of exercises that require manual holding and action.

By extension of application, the apparatus of the present invention may also be utilized to improve the overall balance and the standing posture of a person in general.

Hitherto many different types of exercising devices have been developed which relate to the shaping up of the various parts of the anatomy. However, most of these devices satisfy only one or at most a very few objectives and the consumer has therefore been required to purchase a variety of these equipments to achieve a total or well rounded physical training.

Accordingly, one object of this invention is to provide an exercising device to enable the performance of twisting and turning exercises for the flexing of the anatomy in general. Another object is to provide an exercising apparatus that will enable the performance of many free-hand and calisthenic exercises. Still another object is to provide an apparatus the type which is of a compact size and yet sufficiently durable to readily satisfy the aforementioned objects.

This application is filed as a sequel to and improvement over my earlier application (Japan Utility Model Application No. 52-77073) wherein certain modifications have been effected to simplify the construction of the apparatus. See also my co-pending U.S. application Ser. No. 957,843, filed Nov. 6, 1978.

The foregoing and other features of this invention will be still more appreciated from the following descriptions and claims taken in conjunction with the accompanying drawings wherein:

FIG. 1 is an overall perspective front view of the multiple exerciser device constructed in accordance with this invention;

FIG. 2 is a partial vertical sectional view of the device of FIG. 1 taken along the line II—II; and FIGS. 3A to 8A show various exercise positions.

Figure 4:
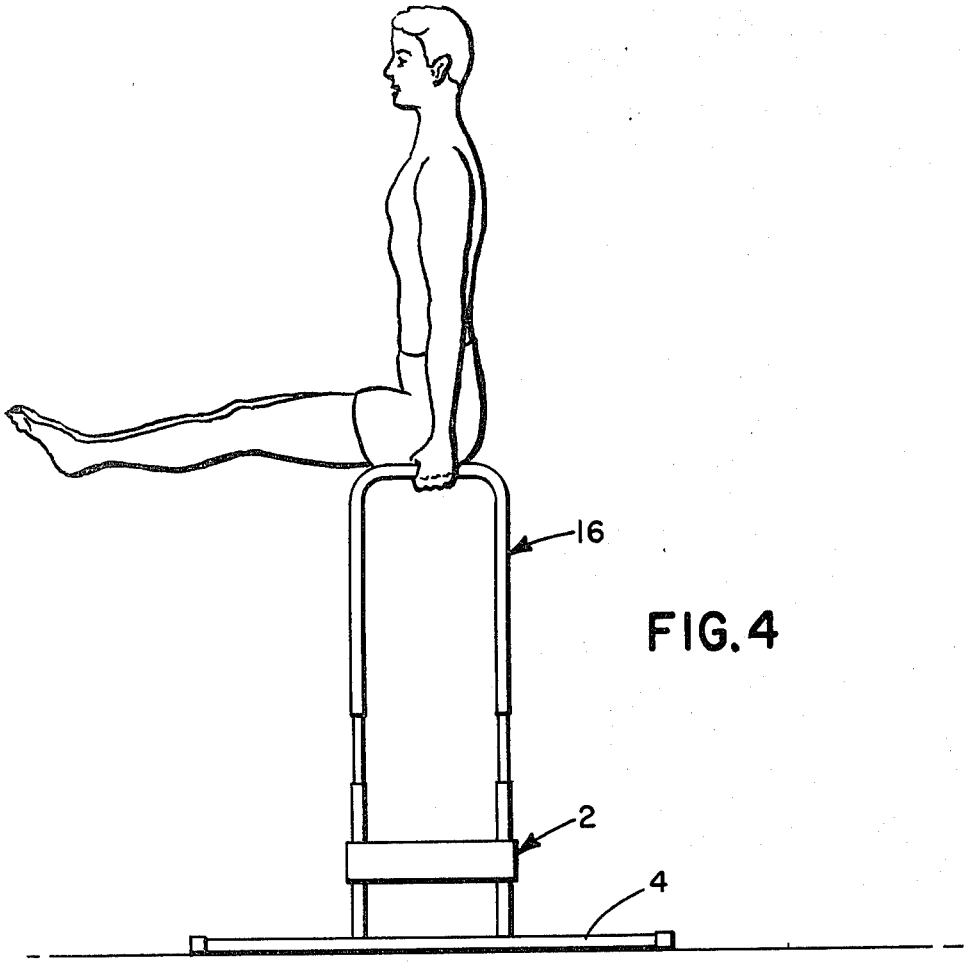

Reference is now directed to FIGS. 1 and 2 which illustrate the multiple exercising apparatus constructed in accordance with the present invention and comprising a box-shaped rectangular base stand 2. The surface 6 of the base stand 2 contains three pre-set holes 8*l*, 8*r*, 8*c* to accommodate the circular turning disks 10 with outboard pre-set holes 8*l* and 8*r* each positioned adjacent to an opposite side of the base stand assembly. These circular disks 10 are inserted in the pre-set holes 8 (8*l*, 8*r*, 8*c*) on the base stand assembly 2 by means of a protruding hub 14 attached to the center of each disk via hub head 12. In this manner these turning disks 10 may be easily attached to or detached from the base assembly 2.

Two parallel U-shaped pipe members 24 penetrate through the base stand assembly 2 at their respective rear ends to become the supporting legs of the base stand 2 which is additionally supported by two outwardly extending relatively short parallel legs or base stand floor stabilizing bars 4 attached perpendicularly to the supporting legs 24 at their outermost ends. This combination provides a very stable and sturdy yet compact support arrangement for the entire device.

Two straight pipe bars 22 are inserted in the supporting legs 24 to become the intermediate pipes which are also inserted in the legs 18 of a pair of inverted U-shaped pipe members 16.

In this manner the combination of the pipe members 24, 22, 18, 16 and 20 will become the supporting bars and the grips or hand-gripping support bars for the hands of the person when aboard the base stand assembly 2 when taking exercises.

Furthermore the supporting bars for the person can be adjusted according to the height of the person by providing spaced holes in pipes 16 and 22, with pins passing through the holes to maintain the cooperating pipes in the desired telescoping position.

Positions (a), (b), (c) and (d) in FIG. 3 show the different positions of the hands and feet when performing twisting and turning exercises.

Figure 5:
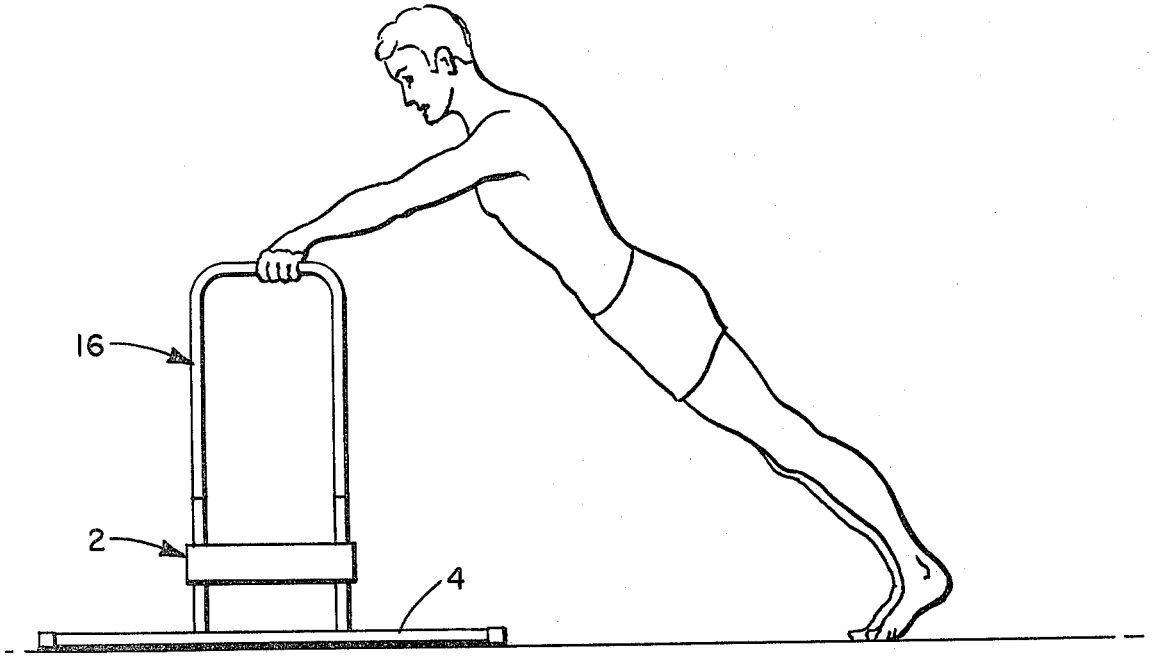
Figure 6:
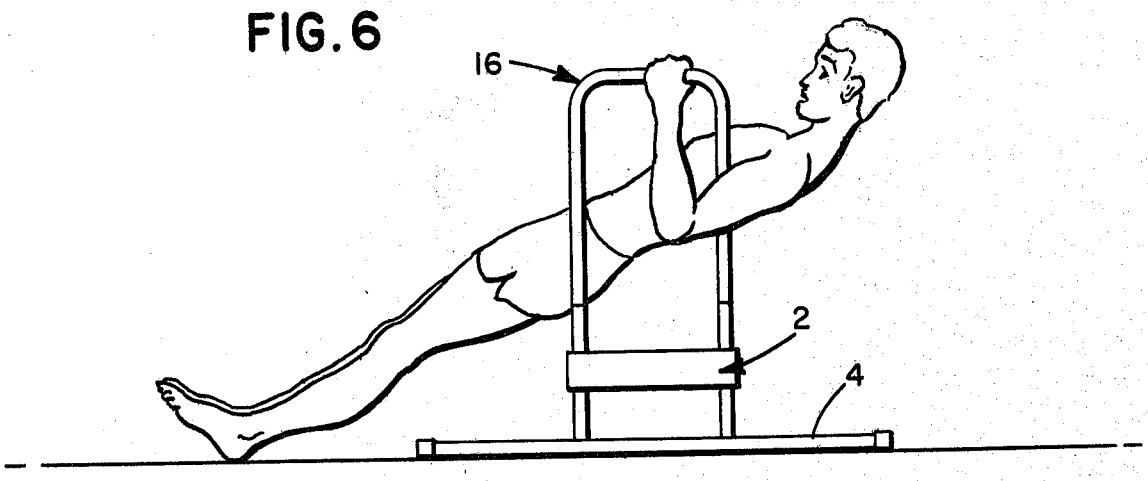
Figure 8:
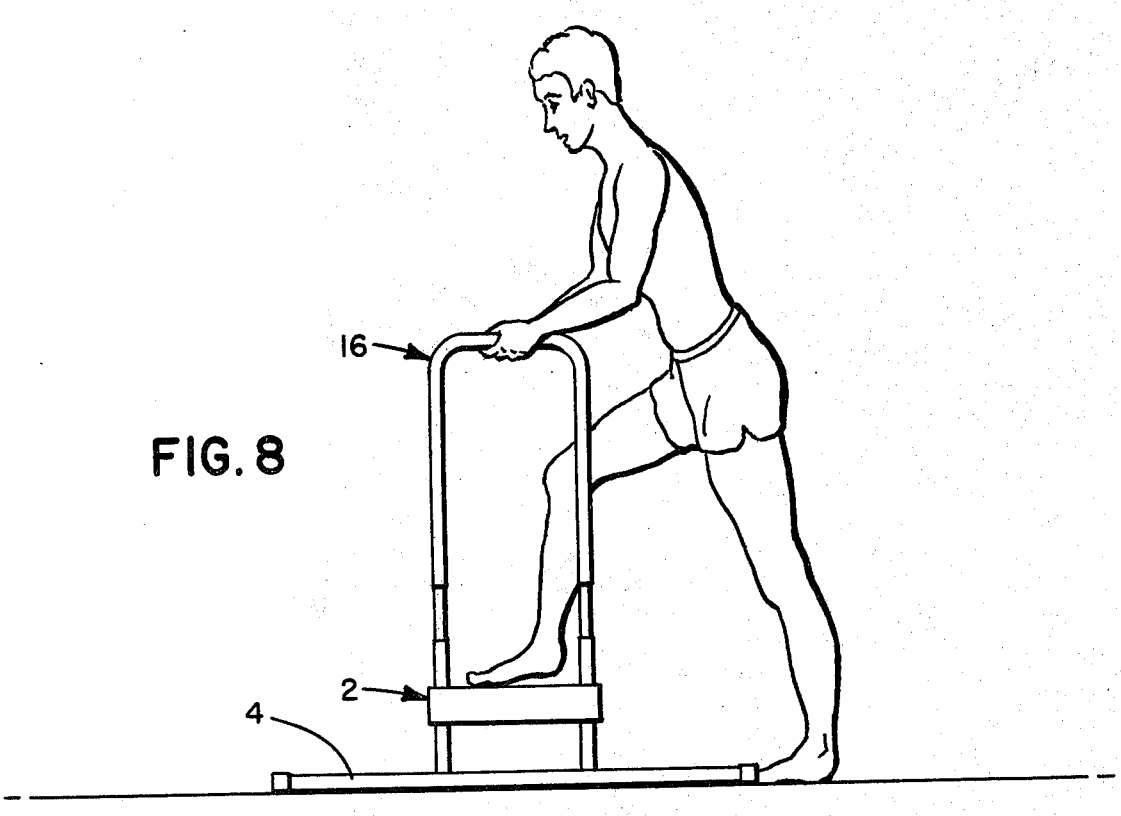

FIGS. 4 through 8 also depict various other exercises performable on this device such as push-ups, stepping, jumping, etc.

What is claimed is:

1. An exercising device for exercising the body of a user comprising a raised supporting base stand assembly having positioned therein spaced apart pre-set holes; a pair of freely rotatable easily detachable circular disks each having a downwardly extending centrally located hub upon which it turns adapted to be inserted in one of said pre-set holes either in single or in dual combination to provide either a disk or a pair of disks that rotate independently of each other by the motion of the body of the user; a parallel pair of hand-gripping support bars, each one attached to and extending upwardly from opposite sides of said base stand assembly, one adjacent to the side of said base stand assembly adapted to receive one of the disks and the other adjacent to the other side of said base stand assembly adapted to receive the other disk; and a pair of spaced base stand floor stabilizing bars extending outwardly from the bottom of the base stand assembly to provide a stable and sturdy support for said device during its use.

2. An exercising device as defined in claim 1 wherein three pre-set holes are placed in alignment at the center of the base stand assembly so that the removable circular disks having downwardly directed protruding hubs may be used either in single or in dual combination by inserting the protruding hub of one of the disks in the center hole on the base stand assembly for single mode and by inserting the protruding hubs of the disks in the outboard pre-set holes located on the right and left of the middle hole for dual disk combination.

3. An exercising device as defined in claim 2 or 1 wherein the hand-gripping support bars are two inverted U-shaped pipe members parallel to each other at their respective rear ends of the base stand assembly.

* * * * *